United States Patent [19]

Colacicco

[11] Patent Number: 4,864,799

[45] Date of Patent: Sep. 12, 1989

[54] AIR OPERATED PLASTIC PAIL CAPPER

[76] Inventor: Ralph D. Colacicco, 3801 Northview Dr., Modesto, Calif. 92355

[21] Appl. No.: 233,533

[22] Filed: Aug. 18, 1988

[51] Int. Cl.[4] ..... B67B 5/02

[52] U.S. Cl. ..... 53/320; 53/321; 53/329

[58] Field of Search ..... 53/319, 320, 321, 329, 53/330, 333, 341, 364, 368, 526, 527

[56] References Cited

U.S. PATENT DOCUMENTS

| | | | |
|---|---|---|---|
| 813,491 | 2/1906 | Edison | 53/527 X |
| 1,495,652 | 5/1924 | Taliaferro | 53/341 X |
| 2,665,832 | 1/1954 | Bagby | 53/321 X |
| 2,717,730 | 9/1955 | Blann | 53/321 X |
| 3,848,396 | 11/1974 | Schmidt | 53/320 X |
| 4,098,059 | 7/1978 | Chattillion | 53/319 |
| 4,312,172 | 1/1982 | Fisher et al. | 53/320 X |

*Primary Examiner*—Robert L. Spruill
*Assistant Examiner*—Linda B. Johnson

[57] ABSTRACT

This air operated plastic pail capper machine is designed to quickly and effectively push a cover onto a pail, while also pushing out any air that may be above the contents of the pail. Primarily, it consists of a base with rollers on top for easy alignment of a pail with a plate attached to a piston rod of an air cylinder, and the air cylinder is mounted to a sleeve attached to a post secured to the base of the machine. Palm operated valves are also employed to operate the machine.

4 Claims, 1 Drawing Sheet

FIG.1
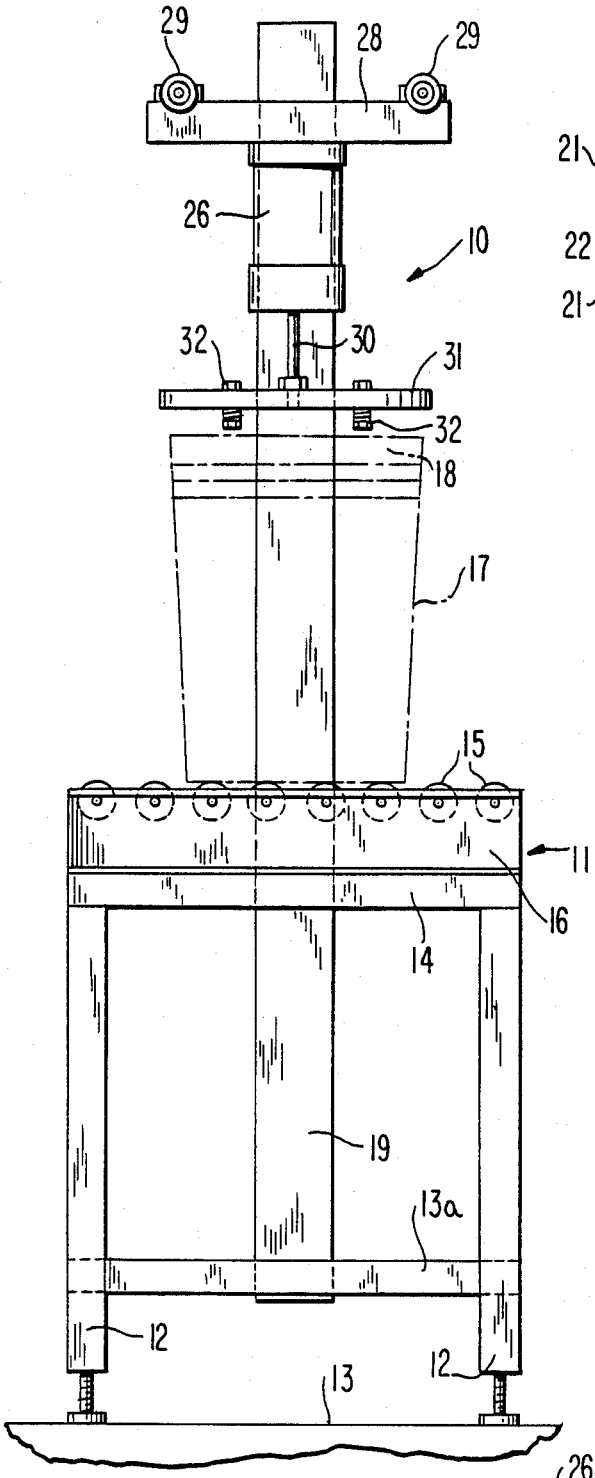
FIG. 2
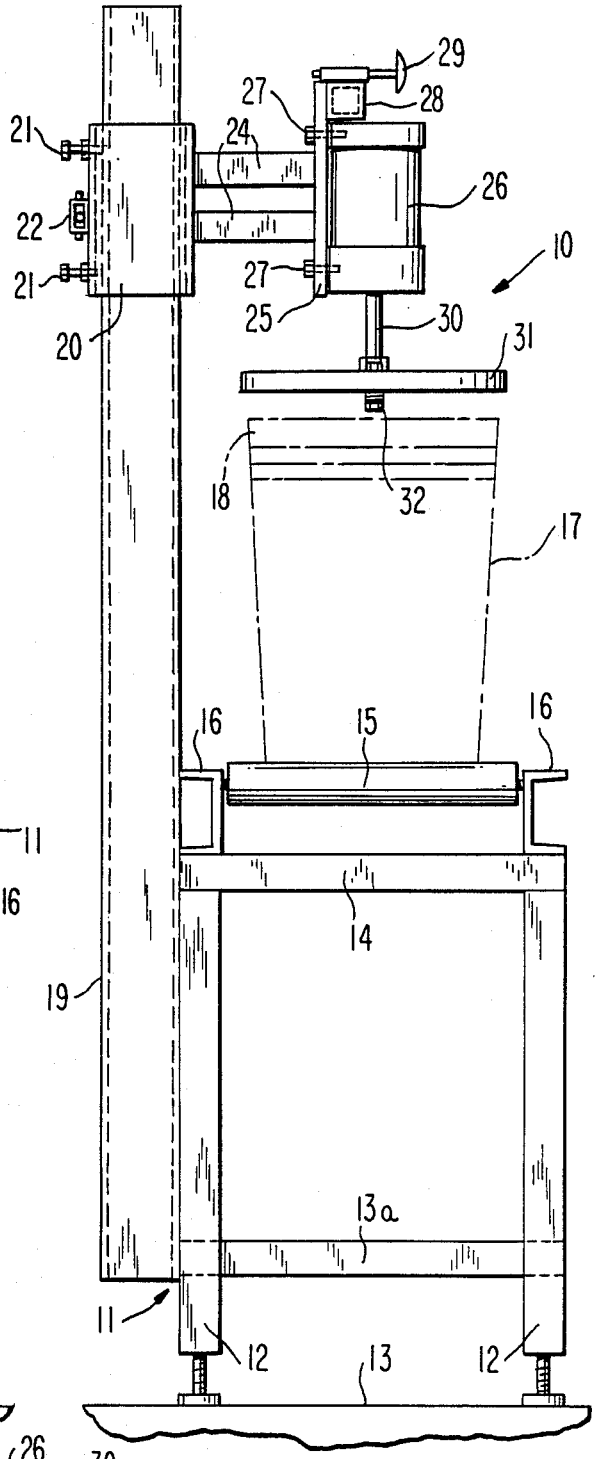
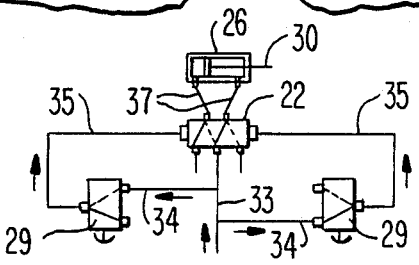
FIG. 3

AIR OPERATED PLASTIC PAIL CAPPER

BACKGROUND OF THE INVENTION

1. Field of the Invention

This invention relates to capping devices, and more particularly to an air operated plastic pail capper.

2. Description of Prior Art

Capping devices are known in the art and are of various types. While these devices may be suitable for the particular purpose to which they address, they will not be as suitable for the particular purpose of the present invention, as will hereinafter be described.

The principal object of this invention is to provide an air operated plastic pail capper that will be of such design, as to eliminate the former necessity of employing rubber mallets to cap plastic pails, and such pails will be capped easier and faster than previously.

Another object of this invention is to provide an air operated plastic pail capper that will be so designed, as to be more efficient and the caps will be sealed 360 degrees, so as to prevent any leakage of the contents.

A further object of this invention is to provide an air operated plastic pail capper that will be simple in design, inexpensive to manufacture, and long lasting.

SUMMARY OF THE INVENTION

An air operated plastic pail capper comprises an adjustable height base with rollers on the top for support of a plastic pail, and a post attached to the base mounts a pneumatic cylinder with a plate thereon for contact with the pail cover. Palm operated buttons are also provided on the cylinder for activating the device.

BRIEF DESCRIPTION OF FIGURES

FIG. 1 is a front view of the instant invention;

FIG. 2 is a side view thereof, and

FIG. 3 is a schematic diagram of the invention.

DETAILED DESCRIPTION

Accordingly, a pail caper machine 10 is shown to include a base 11 having legs 12 that are adjustable in height from floor 13, as desired. Cross braces 13*a* are fixedly secured to legs 12 and a top 14 is fixedly secured to the top portion of base 11. A plurality of equally-spaced rollers 15 are mounted in a pair of spaced channels 16 that are fixedly secured to the top portion of base 11, and rollers 15 engage with the bottom of a plastic pail 17 that is capped with a cap 18, the pail 17 and the cap 18, being shown in phantom lines.

A hollow post 19 is provided and is fixedly secured to cross brace 13*a* and the top 14 of base 11, and a sleeve 20 is received on post 19 and is held in place by set screws 21. A four-way valve 22 is provided on sleeve 22, and a pair of tubes 24 are fixedly secured to the outer periphery of sleeve 24 and are fixedly secured to the rear side of a plate 25 that mounts an air cylinder 26 by fasteners 27. A tubular bar 28 is horizontally secured to the plate 25 above the air cylinder 26, and a pair of palm operated button valves 29 are fixedly secured to ends of bar 28, for the operation of air cylinder 26.

The piston rod 30 of air cylinder 26 is secured to the center of a second plate 31 having a pair of spaced and spring-loaded bolts 32 projecting from an attached second plate 31, the spring-loaded bolts 32 serving to engage with the top of cover 18 of pail 17.

Looking now at FIG. 3, the main air line 33 is coupled to the four-way basic air valve 22 and lines 34 coupled to the palm operated button valves 29 that are of the three-way type. The outputs of valves 209 are also coupled to the basic air valve 22 by lines 35, and lines 37 extend from the valve 22 and are coupled to air cylinder 26.

In operation, the operator uses both hands to push down the palm operated button air valves 29 and this results in energizing the basic air valve 22 that operates the air cylinder 26. When the above occurs, the steel plate 31 moves downward closing the cover 18 onto the pail 17 locking it closed. During the above closing, the spring-loaded bolts 32 push down the center of the cover 18 and removes any air that may be trapped before the cover 18 is completely sealed.

To de-energize machine 10, both palm operated valves 29 must be released together. This causes the plate 31 to return to the normally upward position or starting position.

While various changes may be made in the detailed construction, such details will be within the spirit and scope of the present invention, as defined by the appended claims.

What is claimed is:

1. An air operated plastic pail capper machine comprising: a base; mounting means on said base securing rollers for engagement with a bottom of said pail; an upstanding post secured to said base including an air cylinder support means; an air cylinder secured to said support means, said air cylinder including a depending piston rod; a plate attached to said piston rod, said plate adapted to push a cover down upon said pail; and a pair of spring-loaded bolts dependingly secured to a bottom of said plate, said bolts being arranged to push a center of said cover to remove air trapped in said pail.

2. An air operated plastic pail capper machine as set forth in claim 1, wherein said mounting means includes a pair of spaced channels fixedly secured to a top of said base, and ends of said rollers are freely mounted in said pair of channels, and said rollers enable an operator to easily align said pail with said attached plate that is secured to an end of said piston rod of said air cylinder.

3. An air operated plastic pail capper machine as set forth in claim 2, wherein said post is fixedly secured to said base said air cylinder support means includes a sleeve mounted to an upper end of said post, said air cylinder being fixedly secured to said sleeve above said pail.

4. An air operated plastic pail capper machine as set in forth in claim 3, wherein a pair of push-button palm operated valves are secured to said air cylinder for actuating and releasing said air cylinder that pushes said plate against said cover.

* * * * *